US006418952B1

(12) United States Patent
Worley et al.

(10) Patent No.: US 6,418,952 B1
(45) Date of Patent: Jul. 16, 2002

(54) TENT POLE FOOT ASSEMBLY

(75) Inventors: Lauren Worley, Wichita, KS (US); Raymond J. Olson, Boulder, CO (US); Howard A. Hardee, Wichita, KS (US)

(73) Assignee: The Coleman Company, Inc., Wichita, KS (US)

( * ) Notice: Subject to any disclaimer, the term of this patent is extended or adjusted under 35 U.S.C. 154(b) by 0 days.

(21) Appl. No.: 09/627,832

(22) Filed: Jul. 28, 2000

(Under 37 CFR 1.47)

(51) Int. Cl.[7] ..... E04H 15/00
(52) U.S. Cl. ..... 135/120.3; 135/120.1
(58) Field of Search ..... 135/114–116, 118, 135/119, 120.1, 120.2, 120.3, 120.4, 907

(56) References Cited

U.S. PATENT DOCUMENTS 4,195,651 A * 4/1980 Watts ..... 135/120.3
4,352,362 A * 10/1982 Nichols ..... 135/120.3
4,657,299 A * 4/1987 Mahan ..... 135/88.01
4,782,846 A * 11/1988 Ting ..... 135/120.1
5,333,634 A * 8/1994 Taylor ..... 135/118
5,404,896 A * 4/1995 Howe ..... 135/119
5,615,699 A * 4/1997 Lee ..... 135/118
5,628,336 A * 5/1997 Lee ..... 135/114
5,771,912 A * 6/1998 Swetish ..... 135/119
5,901,726 A * 5/1999 Le Gal ..... 135/120.3
5,954,077 A * 9/1999 Wain ..... 135/119
5,988,194 A * 11/1999 Collins ..... 135/118
6,226,813 B1 * 5/2001 Wilburn ..... 135/118

* cited by examiner

*Primary Examiner*—Beth A. Stephan
(74) *Attorney, Agent, or Firm*—Kramer, Levin, Naftalis & Frankel LLP

(57) ABSTRACT

A tent pole holder includes a first end, a second end, a handle, a partially-cylindrical extension, and an engagement mechanism. The second end may be connected to the first end by a mid-section. The handle may extend between the mid-section and the first end and may have at least one slot. The partially-cylindrical extension may extend between the mid-section and the second end. The engagement mechanism may be located between the mid-section and the second end. The engagement mechanism may include an o-ring recessed in a groove formed along the partially-cylindrical extension. As the partially-cylindrical extension is inserted into a tubular end of the tent pole, the engagement mechanism engages the tent pole. A tent pole foot assembly includes a tent pole, a tent pole holder, and a strap attaching the tent pole holder to a tent through the at least one slot on the handle.

20 Claims, 5 Drawing Sheets

TENT POLE FOOT ASSEMBLY

FIELD OF THE INVENTION

The present invention relates to tent suspension assemblies, and more specifically to tent pole holders of tent pole foot assemblies within tent suspension assemblies.

BACKGROUND INFORMATION

Tent suspension assemblies are well-known in the art. A tent generally includes a fabric shelter supported by a suspension assembly. Tents are popular portable shelters insofar as they often can be easily assembled and disassembled. Assembly of a tent typically involves the creation and proper balancing of tension during construction of the suspension structure. Disassembly involves the release of such tension. Tents are often more easily disassembled than assembled. The extent to which a tent is easily assembled is an important consideration to a consumer when deciding between tent models.

Several tent suspension assemblies are known in the art. Some of the more common types include the use of ropes, poles, stakes, and frames. External suspension assemblies use items surrounding a tent to create the tension necessary to suspend the fabric in order to define an interior space. Such an assembly may rely on driving a stake into the ground, hooking a latch to a frame, or tying a rope to a tree. External suspension assemblies may use, for example, poles held in place with grommets in conjunction with stakes driven into the ground. Grommets are typically affixed into webbing that is sewn to the tent. The tip of a tent pole is inserted into the grommet. With the tip of the tent pole in the grommet, force is exerted to tear out of the webbing, rendering it useless.

Other assemblies use poles and the fabric of the tent itself to create internal tension. Such an assembly uses the fabric to suspend poles of a skeletal-type frame to which the assembly is that it may be a self-contained suspension assembly independent of the surroundings, possibly allowing the tent to be lifted and moved without disassembly.

Self-contained suspension assemblies may have several including greater stability, flexibility of use, and ease of construction. Greater stability may arise if the tent is not reliant on the tension created by an external source, such as a stake that may become uprooted by movement inside the tent. flexibility of use in that they may be used in places where the location does not permit tethering, such as atop a rock mass. Moreover, a self-contained suspension assembly may be easier to construct inasmuch as no hammering or tying may be necessary.

However, even self-contained suspension assemblies have certain disadvantages regarding construction. A typical version of a self-contained suspension assembly includes several tent poles and pockets sewn into the fabric of corners of the tent, into which the tent poles are inserted. With one end of a pole inserted in a pocket at one corner of the tent, the pole may be inserted through loops or sleeves on the perimeter of the tent fabric. Once the pole is attached to the tent perimeter, the other end of the pole is inserted into a pocket sewn into a far corner of the tent. Because the pole is used to create the tension needed to suspend the fabric, the pole may need to be bent before being inserted into the far corner pocket.

Another version of a self-contained suspension assembly is known as a ring and pin system. A ring and pin system uses pins that are inserted in tent poles. The pins are slidably attached to rings that are attached to the tent. The pins have diameters smaller than the inner diameter of the tubular end of the tent pole. The tent poles are held in place on the pins only by the force of the poles against the pins. In the absence of tension, the pins are free to move around, the rings move around, and the pins freely move in and out of the tent poles.

Generally, the tension of a pole used to suspend a tent assembly is a useful force so long as it is controlled to serve its purpose. However, this tension may become troublesome. For example, tension created as a pole is being bent may cause the end of the pole wedged into the first corner pocket to wiggle out of the pocket into which it is inserted. Consequently, the pole may spring out of the pocket as the straightening of the pole releases the tension. Similarly, if using a pole-in-grommet assembly, a first pole tip inserted into a first grommet may become dislodged when attempting to insert the opposite pole tip into its opposing grommet, requiring the first tip to be reinserted into the first grommet. These events may cause much frustration to a person attempting to assemble a tent with many such poles.

Furthermore, even once the pole is suspended between two opposing corner pockets or grommets, the tension from the pole may cause, over time, the pocket or grommet to rip away from fabric to which the pocket or grommet is sewn. Due to the fact that a tent pole often ends in a narrow tip, the majority of the pole tension may be focused on a small surface area of the tip, resulting in a high concentration of pressure at the point at which the pole tip meets the pocket or grommet, respectively. This concentration of force may be sufficient to break down a seam that holds a pocket or a grommet to the tent, either by ripping the fabric or by loosening the stitching. If a pocket or grommet becomes detached, nothing is holding down the pole, and the tension is released. A tent may become unusable if a critical pole may no longer be held in place because a pocket or grommet is missing.

It therefore would be advantageous to design an assembly by which a tent pole may be held in place that would have the benefits of easy and reliable assembly, but avoid several of the shortcomings associated with the use of pockets or grommets in securing the poles.

SUMMARY OF THE INVENTION

The present invention relates to tent suspension assemblies, and more specifically to tent pole holders of tent pole foot assemblies within tent suspension assemblies. A tent pole holder according to an exemplary embodiment of the present invention may include a flat, paddle-shaped handle at a first end, a mid-section, and a partially-cylindrical extension at a second end.

The flat, paddle-shaped handle at the first end may have one or more slots through which straps may attach the tent pole holder to the tent fabric. The mid-section connects and supports the handle and the extension, and it may serve as a place at which to grip the tent pole holder while engaging and disengaging a tent pole. The partially-cylindrical extension at the second end may be inserted into a tubular end of the tent pole that the tent pole holder is intended to engage. The partially-cylindrical extension may include an o-ring that is slightly recessed along the partially-cylindrical extension so as to provide a tighter seal with the tubular end of the tent pole.

The tent pole holder may be attached to the tent fabric anywhere that tension between the tent fabric and the tent pole is desired. An engagement mechanism, such as the o-ring, may be used between the tent pole holder and the tent pole to prevent the tent pole from slipping off the tent pole holder.

DETAILED DESCRIPTION

Figure 1:
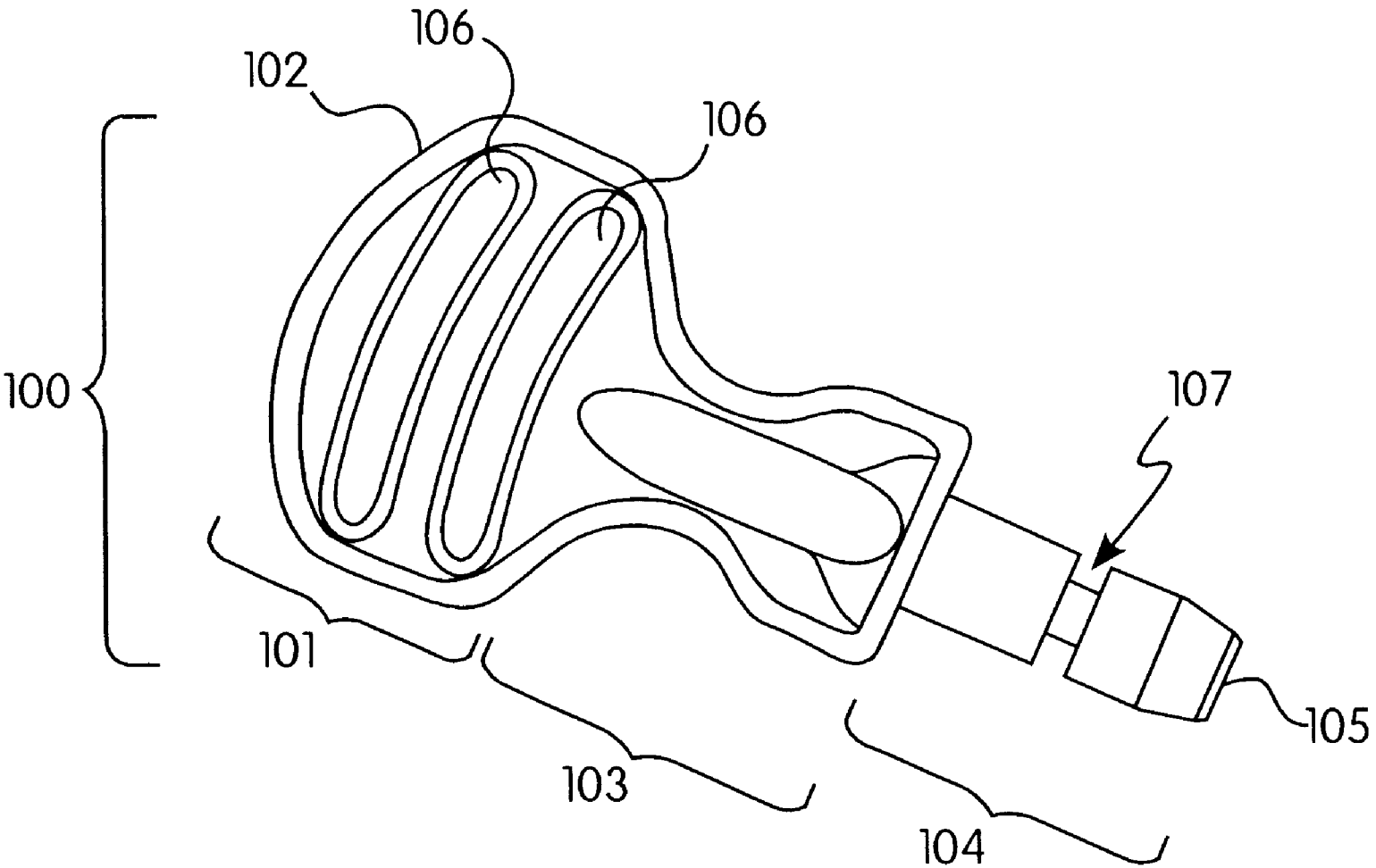
FIG. 1 shows a tent pole holder according to an exemplary embodiment.

Beginning with FIG. 1, FIG. 1 shows a tent pole holder 100 according to an exemplary embodiment. Tent pole holder 100 may include, for example, a flat, paddle-shaped handle 101 at a first end 102, a mid-section 103, and a partially-cylindrical extension 104 at a second end 105.

Figure 5:
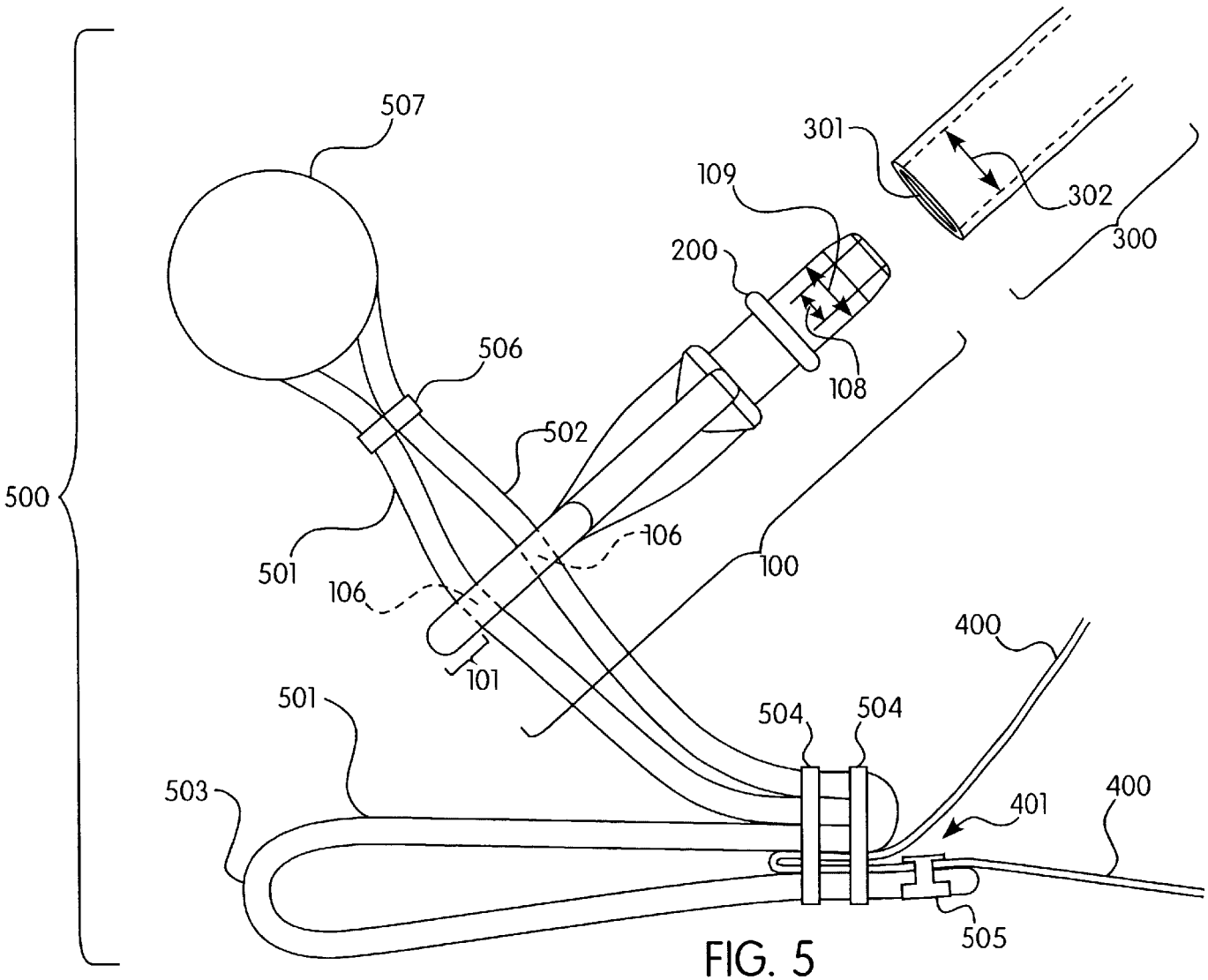
FIG. 5 shows a tent pole holder attached to a tent pole foot assembly according to an exemplary embodiment.

Flat, paddle-shaped handle 101 at first end 102 may have one or more slots 106 through which straps 501 may attach tent pole holder 100 to a tent 400 (shown in FIG. 5). Mid-section 103 may serve as a place at which to grip tent pole holder 100 while engaging and disengaging a tent pole 300. Partially-cylindrical extension 104 at second end 105 may be inserted into a tubular end 301 of tent pole 300 that tent pole holder 100 is intended to engage. Partially-cylindrical extension 104 may include, for example, an o-ring 200 (as shown in FIGS. 3A–3C, 5) that fits within a groove 107 formed near second end 105 along partially-cylindrical extension 104 so as to provide a tighter seal with tubular end 301 of tent pole 300.

Figure 2E:
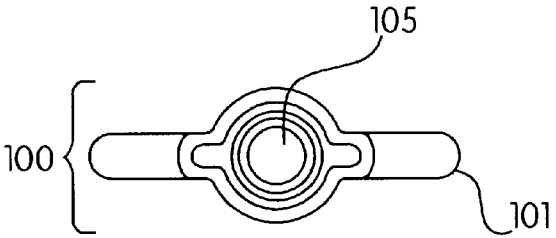
FIG. 2A–2E show a tent pole holder according to another exemplary embodiment.
Figure 2D:
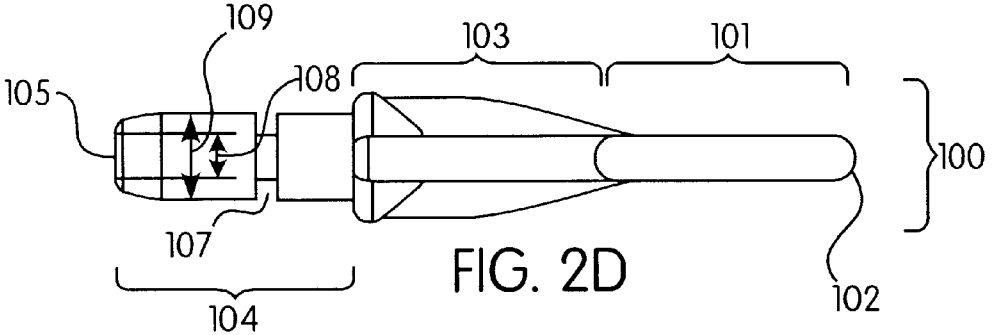
Figure 2A:
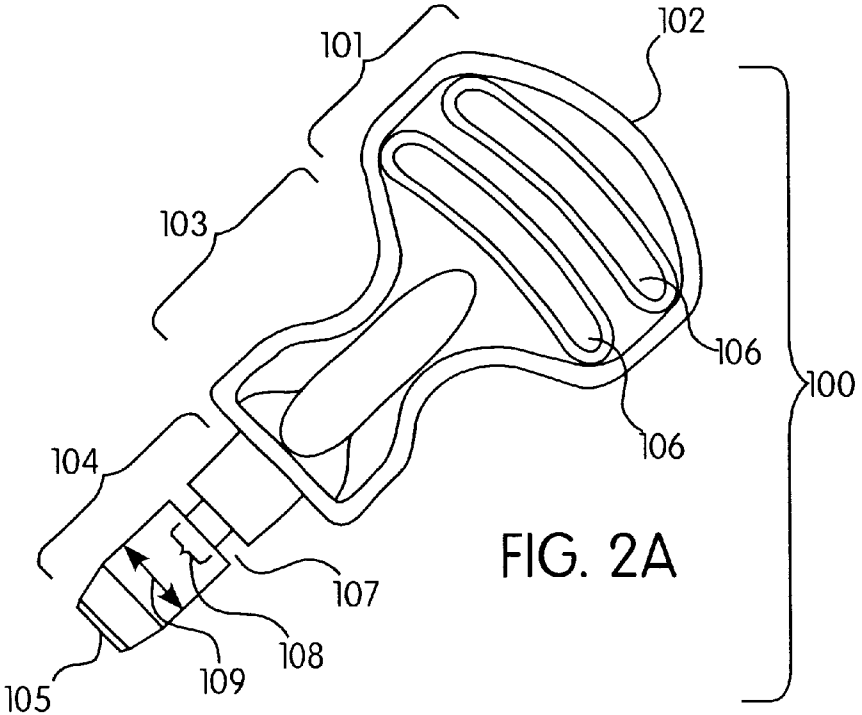
Figure 2B:
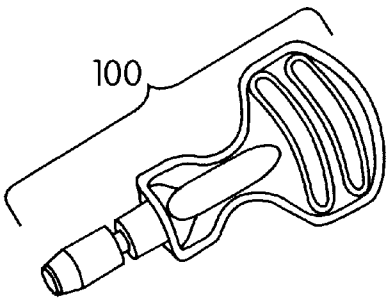
Figure 2C:
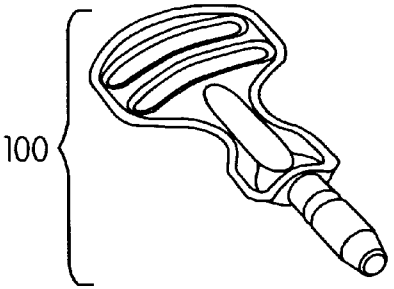

FIGS. 2A–2E show tent pole holder 100 from a variety of perspectives according to another exemplary embodiment. FIG. 2A shows a top view; FIGS. 2B and 2C show angled perspectives; FIG. 2D shows a side view; and FIG. 2E shows a front view. Mid-section 103 is shown as having, for example, a tapered, reinforced, hourglass shape, but the appearance of mid-section 103 may vary widely. Mid-section 103 serves to connect and provide structural support between handle 101 and partially-cylindrical extension 104, so mid-section 103 may be any shape that accomplishes these purposes.

Similar to FIGS. 2B and 2C, a typical tent pole holder 100 would be, for example, approximately 2.25 inches long, with some variation, for a typical tent pole foot assembly 500. Tent pole holder 100 may be made of, for example, metal or hard plastic. For example, tent pole holder 100 may be made of cast aluminum to be strong yet light. Likewise, tent pole 300 may be made, for example, of metal or plastic, depending on the nature of its use.

Figure 3C:
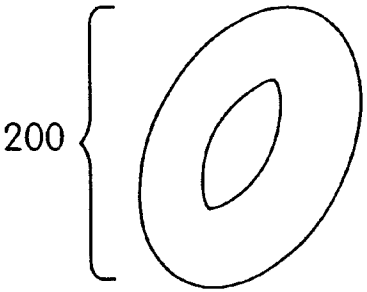
FIGS. 3A–3C show an o-ring according to an exemplary embodiment.
Figure 3B:
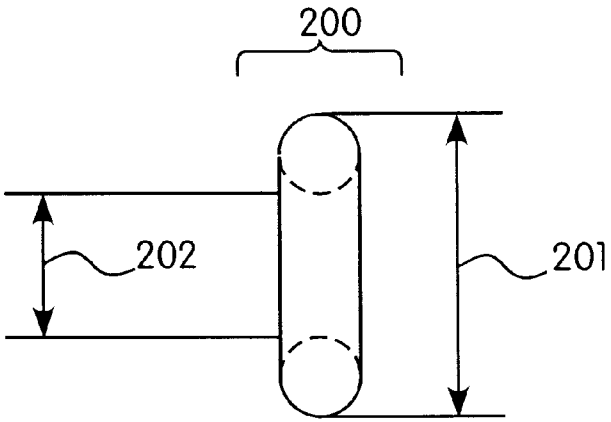
Figure 3A:
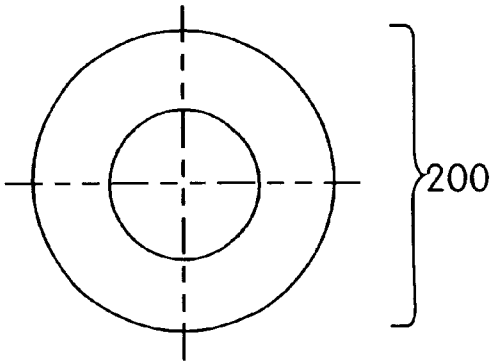

FIGS. 3A–3C show an o-ring 200 according to an exemplary embodiment. Referring to FIG. 3B, o-ring 200 could be slightly wider in its outer diameter 201 than the inner diameter 302 of tubular end 301 of tent pole 300 (shown in FIG. 5), so that a tight seal is formed between o-ring 200 and inner diameter 302. As tent pole holder 100 is inserted into tent pole 300, outer diameter 201 of o-ring 200 flattens, causing friction between tent pole holder 100 and tent pole 300. Likewise, for example, o-ring inner diameter 202 may be slighter narrower than a diameter 108 of groove 107 formed on tent pole holder 100, so that o-ring 200 remains in place (shown in FIGS. 2A, 2D). O-ring 200 may be made, for example, of rubber to facilitate placement in groove 107 because o-ring 200 would need to stretch over second end 105 before being rolled into groove 107. By contrast, diameter 109 of partially-cylindrical extension 104 would, for example, approximately match but not exceed inner diameter 302 of tubular end 301 of tent pole 300, to provide a tight fit but still permit insertion and removal of partially-cylindrical extension 104 from tubular end 301.

The seal formed by o-ring 200 is a simple, reliable engagement mechanism 203 between tent pole holder 100 and tent pole 300. In one exemplary embodiment, approximately 1.5 kg*9.8m/s$^2$ of force may be required separate tent pole holder 100 with o-ring 200 from tent pole 300 (i.e., equivalent to the gravitational force exerted by a 1.5 kg weight when suspended from a vertical tent pole holder 100).

Figures 4A, 4B, 4C, 4D, 4E:
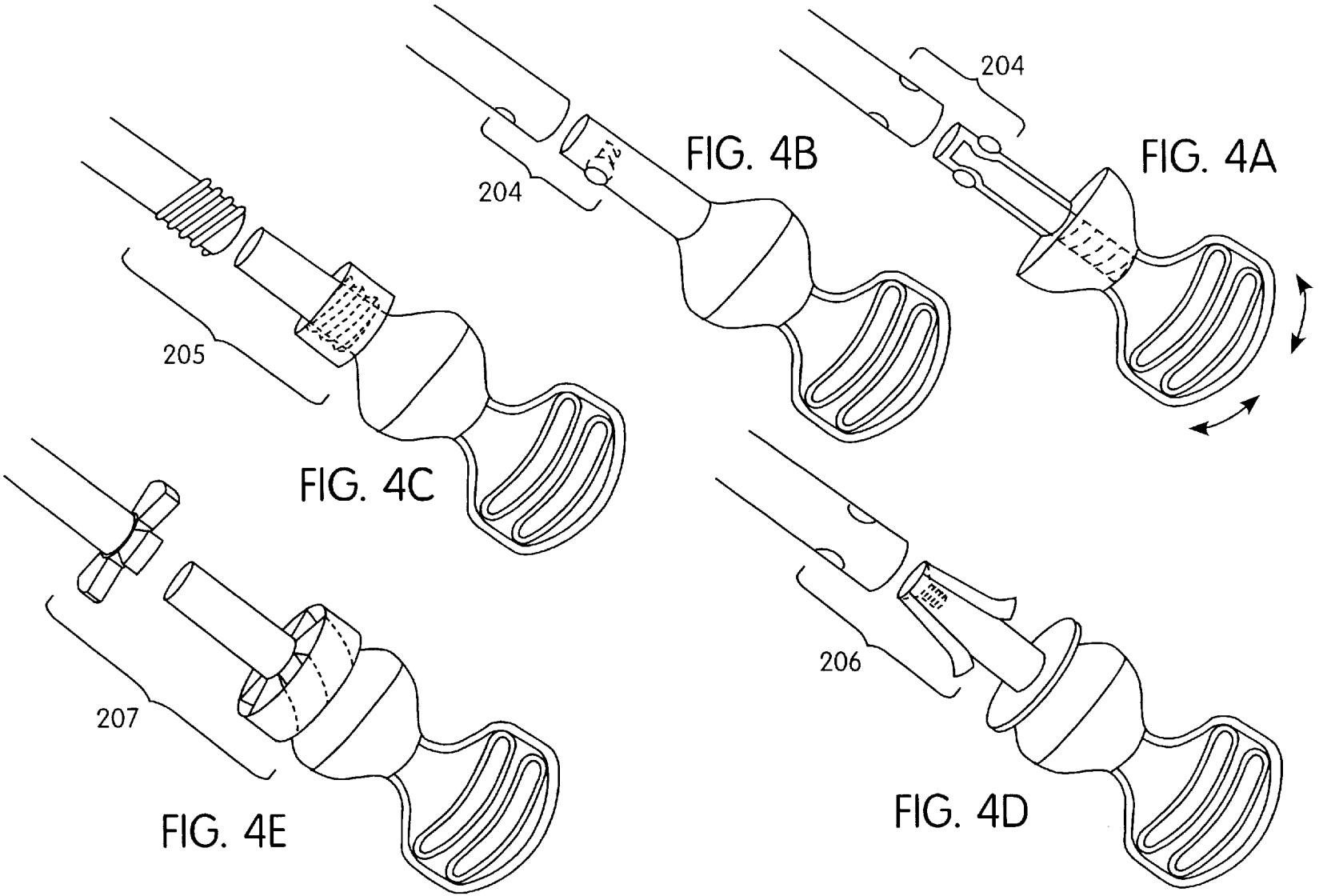
FIGS. 4A–4E show engagement mechanisms according to additional exemplary embodiments.

Alternatively, other engagement mechanisms 203 may be used instead of an o-ring 200 seal. Engagement mechanisms may be either self-releasing, as in o-ring 200 under appropriate force, or manually-releasing, as with some twisting or screwing mechanisms. As shown in FIGS. 4A–4E, possible engagement mechanisms 203 that may be employed include, for example, a spring-loaded ball bearing/groove mechanism 204 (FIGS. 4A, 4B), a threaded nut/bolt-style mechanism 205 (FIG. 4C), a spring-loaded tooth/slot mechanism 206 (FIG. 4D), and a tooth/slot twist mechanism 207 (FIG. 4E).

FIG. 5 shows tent pole holder 100 attached to a tent pole foot assembly 500 according to an exemplary embodiment. Tent pole holder 100 may be attached to tent fabric 400 anywhere that tension between tent 400 and tent pole 300 is desired, such as at a corner 401 where a tent pole pocket or grommet might otherwise have been placed to hold tent pole 300. Instead of placing tent pole 300 into a tent pole pocket or grommet as in the prior art, tent pole 300 may engage tent pole holder 100 directly as tent pole holder 100 may be inserted into tubular end 301 of tent pole 300.

Tent pole holder 100 may be attached to tent 400 by a strap 501 forming a holder loop 502 and a stake loop 503. Strap 501 may be secured to tent 400 by, for example, stitching 504 and a box tack 505. Holder loop 502 may pass through slots 106 of flat paddle 101 and may be closed by stitching 506. Stitching 506 serves to restrict the outward movement of tent pole holder 100. Holder loop 502 may also pass through a side-squeeze fly buckle 507, which may be used as an attachment point for a rain fly that would contain the other half of the buckle 507 mechanism. Stake loop 503 could be used to secure tent 400 to the ground if necessary.

Once tent 400 has been constructed, tent pole 300 presses against tent pole holder 100, keeping tent pole 300 securely in place. Strap 501 of holder loop 502 more evenly distributes the force of the tent assembly by pulling in the direction of the tent fabric 400, instead of perpendicular to tent fabric 400. As tent 400 is being assembled, however, engagement mechanism 203, such as o-ring 200, may be used between tent pole holder 100 and tent pole 300 to prevent tent pole 300 from slipping off tent pole holder 100. Engagement mechanism 203 is designed to prevent unintentional removal of tent pole 300 from tent pole holder 100, while providing only minimal resistance to the intentional disengagement of tent pole 300 from tent pole holder 100.

With tent pole 300 engaged to tent pole holder 100, the remainder of the tent suspension assembly may be more easily assembled, without worrying about a far end of tent pole 300 slipping while a near end of the pole is being positioned. Moreover, the tent suspension assembly gains additional stability from the combined effect of engagement mechanisms 203 between tent poles 300 and tent pole holders 100. Therefore, once fully assembled, the tent suspension assembly is less vulnerable to an unintentional disassembly that might be caused by movement within or around tent 400.

A number of embodiments of the present invention have been described above. Nevertheless, it will be understood that various modifications may be made without departing from the spirit and scope of the invention. Accordingly, other embodiments are within the scope of the following claims. It is intended that all matter contained in the above description or shown in the accompanying drawings shall be interpreted as illustrative and not in a limiting sense. It is also understood that the following claims are intended to cover all of the generic and specific features of the invention herein described and all statements of the scope of the invention, which, as a matter of language, might be said to fall therebetween.

We claim:

1. A tent pole holder comprising:

a first end;

a second end connected to the first end by a mid-section;

a handle formed between the mid-section and the first end, the handle having at least one slot;

a partially-cylindrical extension formed between the mid-section and the second end; and an engagement mechanism located between the mid-section and the second end, the engagement mechanism engageable with a tent pole when the partially-cylindrical extension is inserted into a tubular end of the tent pole.

2. The tent pole holder of claim 1, wherein the handle is adapted to be strapped to a tent through the at least one slot.

3. The tent pole holder of claim 1, wherein the handle includes two slots.

4. The tent pole holder of claim 1, wherein the tent pole holder is made of cast aluminum.

5. The tent pole holder of claim 1, wherein the engagement mechanism includes a self-releasing engagement mechanism.

6. The tent pole holder of claim 5, wherein the engagement mechanism includes an o-ring recessed in a groove formed along the partially-cylindrical extension.

7. The tent pole holder of claim 5, wherein the engagement mechanism includes a spring-loaded ball bearing/groove mechanism.

8. The tent pole holder of claim 1, wherein the engagement mechanism includes a manually-releasing mechanism.

9. The tent pole holder of claim 8, wherein the engagement mechanism includes a threaded nut/bolt-style mechanism.

10. The tent pole holder of claim 8, wherein the engagement mechanism includes a spring-loaded tooth/slot mechanism.

11. The tent pole holder of claim 8, wherein the engagement mechanism includes a tooth/slot twist mechanism.

12. A tent pole foot assembly comprising:

a tent pole;

a tent pole holder insertable into the tent pole, the tent pole and the tent pole holder including an engagement mechanism, and the tent pole holder being releasably engageable to the tent pole; and a strap for attaching the tent pole holder to a tent, the strap and the tent pole holder including an attachment mechanism adapted to attach the tent pole holder and the strap in the absence of the tent pole;

wherein the tent pole holder attaches to the tent by the strap, and wherein inserting the tent pole holder into the tent pole causes the engagement mechanism to releasably secure the tent pole to the tent pole holder and the tent, the tent pole holder having been attached to the tent by the strap, such that the tent pole holder and the tent pole do not disengage when the tent pole is not exerting tension on the tent.

13. The tent pole foot assembly of claim 12, wherein the tent pole holder after engagement to the tent pole exerts a force parallel to a plane of a weave of a fabric portion of the tent when the tent pole holder is attached to the strap and the strap is attached to the fabric portion of the tent.

14. A tent pole foot assembly comprising:

a tent pole;

a tent pole holder insertable into the tent pole and releasably engageable to the tent pole; and a strap for attaching the tent pole holder to a tent;

wherein the tent pole holder attaches to the tent by the strap, and wherein inserting the tent pole holder into the tent pole releasably secures the tent pole to the tent pole holder and the tent, the tent pole holder having been attached to the tent by the strap; and wherein the tent pole holder includes:

a first end;

a second end connected to the first end by a mid-section;

a handle formed between the mid-section and the first end, the handle having at least one slot;

a partially-cylindrical extension formed between the mid-section and the second end; and an engagement mechanism located between the mid-section and the second end, the engagement mechanism engaging the tent pole as the partially-cylindrical extension is inserted into a tubular end of the tent pole.

15. The tent pole foot assembly of claim 14, wherein the handle is strapped to the tent through the at least one slot.

16. The tent pole foot assembly of claim 14, wherein the tent pole holder is made of cast aluminum or hard plastic.

17. The tent pole foot assembly of claim 14, wherein the tent pole is made of cast aluminum or hard plastic.

18. The tent pole foot assembly of claim 14, wherein the engagement mechanism includes a self-releasing engagement mechanism.

19. The tent pole foot assembly of claim 18, wherein the engagement mechanism includes an o-ring recessed in a groove formed along the partially-cylindrical extension.

20. The tent pole foot assembly of claim 14, wherein the engagement mechanism includes a manually-releasing mechanism.

* * * * *